US009504865B2

(12) United States Patent
Skwiot et al.

(10) Patent No.: US 9,504,865 B2
(45) Date of Patent: Nov. 29, 2016

(54) TRAPEZE APPARATUS AND METHOD

(71) Applicant: Aerialates LLC, Circle Pines, MN (US)

(72) Inventors: Elizabeth Skwiot, San Diego, CA (US); Jacob Barlow Kimball, St. Paul, MN (US)

(73) Assignee: Aerialates LLC, San Diego, CA (US)

( * ) Notice: Subject to any disclaimer, the term of this patent is extended or adjusted under 35 U.S.C. 154(b) by 61 days.

(21) Appl. No.: 14/681,870

(22) Filed: Apr. 8, 2015

(65) Prior Publication Data

US 2016/0296783 A1 Oct. 13, 2016

(51) Int. Cl.
*A63B 7/02* (2006.01)

(52) U.S. Cl.
CPC ..... *A63B 7/02* (2013.01); *A63B 2225/09* (2013.01); *A63B 2244/12* (2013.01)

(58) Field of Classification Search
CPC . A63B 1/00–1/005; A63B 7/00; A63B 7/02; F16L 3/12; F16L 3/1215–3/1222; F16L 3/133
USPC ..... 482/24
See application file for complete search history.

(56) References Cited

U.S. PATENT DOCUMENTS

| | | | | |
|---|---|---|---|---|
| 342,194 | A | 5/1886 | Finnegan et al. | |
| 423,730 | A | 5/1890 | Charlton | |
| 818,700 | A | 4/1906 | Morewood et al. | |
| 1,200,321 | A | 10/1916 | Denning et al. | |
| 1,661,188 | A | 3/1928 | Matthews | |
| 3,211,409 | A | 10/1965 | Zimmermann et al. | |
| 3,233,894 | A | 2/1966 | Binan | |
| 3,701,215 | A | 10/1972 | Marason et al. | |
| 4,223,862 | A | 9/1980 | Doughty | |
| 4,492,373 | A * | 1/1985 | Dzitzer | A63B 7/00 482/143 |
| 4,606,539 | A * | 8/1986 | Farnham | A63B 21/0023 482/148 |

(Continued)

FOREIGN PATENT DOCUMENTS

| | | |
|---|---|---|
| EP | 2181734 | 5/2010 |

OTHER PUBLICATIONS

"Aerialates is taking suspension training to a whole new level!," Aerialates Trapeze System Advertisement sent to clients on Nov. 5, 2012 (7 pages).

"Aerialates Television Disclosure," Screenshots from Fox Morning Buzz Studio broadcast on Jan. 18, 2010, retrieved from https://www.youtube.com/watch?v=sDxgRkV0S7s (3 pages).

(Continued)

*Primary Examiner* — Loan H Thanh
*Assistant Examiner* — Jennifer M Deichl
(74) *Attorney, Agent, or Firm* — Pauly, Devries, Smith & Deffner, LLC

(57) ABSTRACT

A trapeze bar assembly provides an elongated support member that can be removably coupled with first and second coupling mechanisms. The coupling mechanisms can couple the support member to flexible suspension members to suspend the support member in the air. The coupling mechanisms can be infinitely positionable along the suspension members. The coupling mechanisms also each include a frame member with an opening that receives one end of the support member. Retention features on the support bar and the frame member can removably retain the end of the support bar within the frame member. The support member can also be rotatably fixed relative to the frame members via cooperating engagement features. A trapeze system is also provided including a support member, coupling mechanisms, and first and second flexible suspension members for suspending the support member. A method for assembling a trapeze apparatus is also provided.

20 Claims, 5 Drawing Sheets

(56) References Cited

U.S. PATENT DOCUMENTS

| | | | | |
|---|---|---|---|---|
| 6,258,011 | B1 | 7/2001 | Wolfe | |
| 7,255,666 | B2 | 8/2007 | Cardenas | |
| 7,909,748 | B2 | 3/2011 | Calvagne et al. | |
| 8,088,053 | B2 | 1/2012 | Whyatt et al. | |
| 8,480,549 | B1 | 7/2013 | Hinds et al. | |
| 2010/0113235 | A1* | 5/2010 | Calvagne ..... | A63B 7/02 482/143 |

OTHER PUBLICATIONS

"Explanation of the Aerialates Television Disclosure," signed by Elizabeth Skwiot on Apr. 8, 2015 (1 page).
"Explanation of the Aerialates Trapeze System Advertisement Disclosure," signed by Elizabeth Skwiot on Apr. 8, 2015 (1 page).
"Review: Jukari Fit to Fly," Shape Up NYC, posted on Apr. 28, 2010, retrieved May 14, 2014 from http://shapeupnyc.com/2010/04/28/reviewjukarifittofly/ (4 pages).

* cited by examiner

TRAPEZE APPARATUS AND METHOD

FIELD

This disclosure generally relates to aerial equipment useful for exercise, physical training, aerial acrobatics, and circus acts, among other types of activities. This disclosure more specifically relates to trapeze bars and systems that may be used in exercise and training programs.

BACKGROUND

Trapeze systems are generally well known. In a simple form, a trapeze typically includes a horizontal bar that is hung from an elevated support structure by ropes, straps, webbing, or another type of support line. Trapeze systems are used in a variety of settings for different purposes. One common example is the use of a trapeze for aerial acts in circus, dance, and other types of performances. Performers may balance on the trapeze bar, move around the bar and ropes, hang from the bar, swing on the bar, spin on a bar mounted on a single point, and perform a wide range of other acts.

Trapeze systems are an increasingly common element of some types of exercise and physical training routines. Trainers and instructors can find a trapeze bar particularly useful in developing a participant's strength, balance, judgment and poise. While performers and other professionals may use custom designed and custom built trapeze systems, the increasing use of trapeze systems within exercise programs, and otherwise by the general public, presents a need for trapeze systems that can be adjusted to suit people of varying heights, weights, and capabilities. The same trapeze system may also be used in various locations, and thus is can be helpful have a trapeze system that can be easily assembled and disassembled.

While some past trapeze systems have been developed with these and other needs in mind, there remains a desire for new and improved trapeze systems that address these and other issues.

SUMMARY

Embodiments of the invention relate to a trapeze system. One possible embodiment provides a trapeze system that includes an elongated support member, first and second flexible suspension members, a first coupling mechanism, and a second coupling mechanism coupling. The suspension members are for suspending the elongated support member. The first and second coupling mechanisms couple the first flexible suspension member to the elongated support member, and the second flexible suspension member to the elongated support member, respectively. Each of the coupling mechanisms includes a frame member, a frame retention feature, a slot, and a frame engagement feature. The elongated support member includes an end that has an end retention feature and an end engagement feature. The frame member defines an opening that is configured to receive the end of the elongated support member. The frame member also includes a frame retention feature that engages the end retention feature to removably retain the end of the elongated support member within the frame member. The slot is in communication with the opening, and is configured to receive the end of the elongated support member from the opening. The frame engagement feature engages the end engagement feature to rotatably fix the end of the elongated support member.

In one example, the first and the second coupling mechanisms can be infinitely positionable along lengths of the first flexible suspension member and the second flexible suspension member, respectively. In this case each of the first and the second coupling mechanisms may include a releasable clamp that selectively grips and moves along the corresponding flexible suspension member. The flexible suspension members can be separate lengths of webbing.

In some cases the frame member of the coupling mechanisms has a rigid planar member with a perimeter region that encloses the opening and the slot. The end of the elongated support member can optionally include an inner flange and an outer flange, and in some cases at least part of the rigid planar member is positioned between the inner and the outer flanges.

In some examples of the trapeze system, a rotational alignment of the end retention feature and the frame retention feature permits removal of the end of the elongated support member from the frame member. Rotation of the end of the elongated support member at one end of the slot can engage the end engagement feature with the frame engagement feature. In some cases engagement of the end engagement feature and the frame engagement feature rotatably fixes the end of the elongated support member in a rotational alignment with the frame member. The rotational alignment can be different than the rotational alignment of the end retention feature and the frame retention feature.

Some embodiments include a trapeze bar assembly that may be part of a trapeze system or optionally provided apart from flexible suspension members such as webbing, ropes, straps, and the like. One example of a trapeze bar assembly includes an elongated support member with a first end and a second end. Each of the ends have an end retention feature and an end engagement feature. The assembly also includes first and second coupling mechanisms. Each coupling mechanism has a frame member that defines an opening configured to receive one of the ends of the elongated support member. The coupling mechanism also includes a frame retention feature configured to engage a corresponding end retention feature of the elongated support member. Engagement of the corresponding retention features removably retains the end of the elongated support member within the frame member. The coupling mechanism also includes a slot in communication with the opening. The slot is configured to receive the end of the elongated support member from the opening. The coupling mechanism also includes a frame engagement feature configured to engage a corresponding end engagement feature, which rotatably fixes the end of the elongated support member within the slot. According to this example, the first and the second coupling mechanisms are configured to couple the first and the second ends to corresponding first and second flexible suspension members. In addition, the first and the second coupling mechanisms are infinitely positionable along corresponding lengths of the first and the second flexible suspension members.

In some cases, the first and the second ends of the elongated support member each have an inner flange and an outer flange. The flanges restrict translation of the first and the second coupling mechanisms along the elongated support member in an assembled state. In some such cases, the frame member of each of the first and the second coupling mechanisms includes a rigid planar member that fits between the inner and the outer flanges. The rigid planar member of each frame member can have a perimeter region that encloses the opening and the slot of the corresponding coupling mechanism. In some cases each of the first and the second coupling mechanisms can include a releasable clamp configured to selectively grip and move along the first or the second flexible suspension member.

The retention and engagement features of the coupling mechanisms and elongated support member can have different forms. As an example, the end retention feature can be a notch and the frame retention feature can be a protrusion. As another example, the end engagement feature can include a recess in the elongated support member. The frame engagement feature can optionally be a protrusion extending into the slot. Other configurations may also be an option, including configurations in which the end retention and engagement features are protrusions and the frame retention and engagement features are notches/recesses, respectively.

Some embodiments of the invention provide a method for assembling a trapeze apparatus, such as one of the trapeze apparatuses described herein. As an example, one possible method for assembling a trapeze apparatus relates to a trapeze apparatus having an elongated support member and first and second coupling mechanisms. The method in this example includes removably coupling a first end of the elongated support member with the first coupling mechanism and removably coupling a second end of the elongated support member with the second coupling mechanism. Removably coupling one of the ends with one of the coupling mechanisms includes aligning a retention feature of the end of the elongated support member with a retention feature of the coupling mechanism and then inserting the end into an opening of the coupling mechanism. Removably coupling an end with a coupling mechanism also includes moving the end of the elongated support member from the opening into a slot of the coupling mechanism, and aligning an engagement feature of the end of the elongated support member with an engagement feature of the coupling mechanism thereby fixing rotation of the end of the elongated support member relative to the coupling mechanism.

The method for assembling a trapeze apparatus can in some cases include coupling the first coupling mechanism to a first flexible suspension member and coupling the second coupling mechanism to a second flexible suspension member. Another step in the method can include moving the first coupling mechanism along the first flexible suspension member to one of an infinite number of positions on the first flexible suspension member and moving the second coupling mechanism along the second flexible suspension member to one of an infinite number of positions on the second flexible suspension member. Further, in some cases aligning the retention features involves rotating the end of the elongated support member into a first rotational alignment with the coupling mechanism, and aligning the engagement features comprises rotating the end of the elongated support member into a second rotational alignment with the coupling mechanism different than the first rotational alignment.

These and various other features and advantages will be apparent from a reading of the following detailed description.

BRIEF DESCRIPTION OF THE DRAWINGS

The following drawings illustrate some particular embodiments of the present invention and therefore do not limit the scope of the invention. The drawings are not to scale (unless so stated) and are intended for use in conjunction with the explanations in the following detailed description. Some embodiments will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing some embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1A:
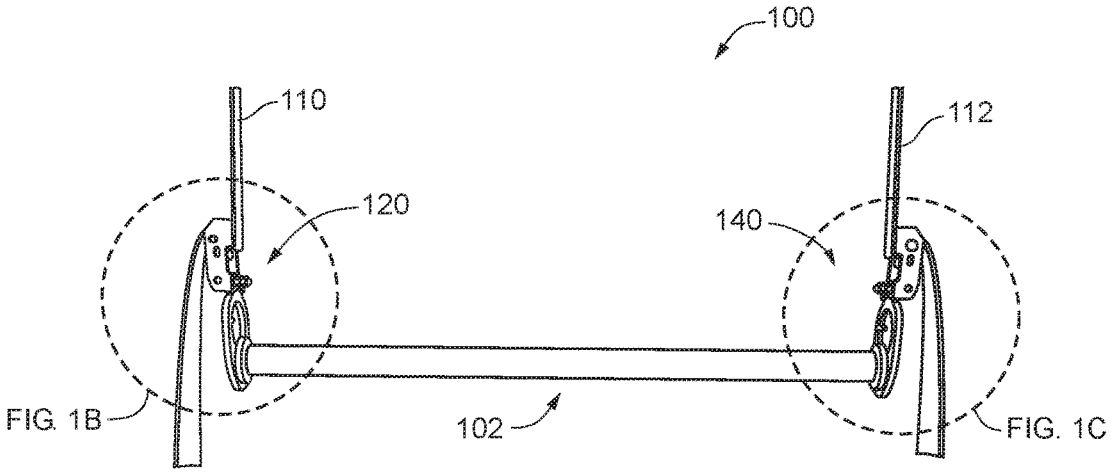
FIG. 1A is a front perspective view of a trapeze system according to an embodiment of the invention.

FIG. 1A is a perspective view of a trapeze system 100 according to one possible embodiment of the invention. The trapeze system 100 includes an elongated support member 102, which is also referred to herein as simply a "support member." As will be discussed, the support member 102 may optionally be a solid bar, a tube, or have a different configuration, and may be formed from a variety of materials. The support member 102 is suspended from an elevated support (not shown) by a first flexible suspension member 110 and a second flexible suspension member 112. A first coupling mechanism 120 couples the support member 102 to the first suspension member 110, and a second coupling mechanism 140 couples the support member 102 to the second suspension member 112.

Figure 1B:
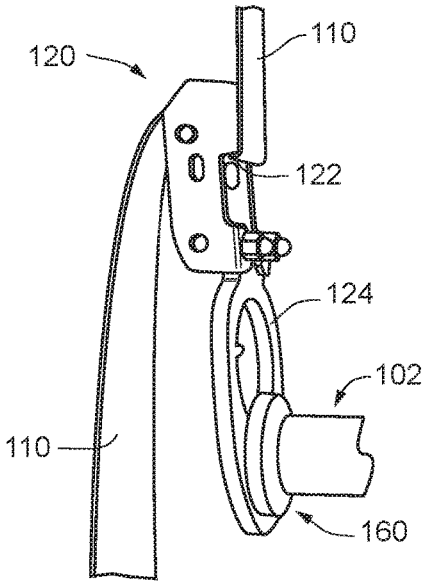
FIGS. 1B and 1C are enlarged perspective views of portions of the trapeze system shown in FIG. 1A.
Figure 1C:
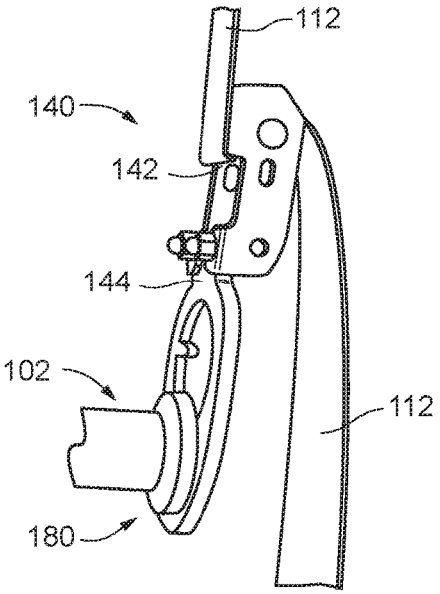

FIGS. 1B and 1C are enlarged views of the coupling mechanisms 120, 140 shown in FIG. 1A. In this illustrated embodiment, each of the coupling mechanisms 120, 140 includes a releasable clamp 122, 142, and is coupled to one of the suspension members 110, 112 by threading the suspension member through the clamp. Each of the coupling mechanisms 120, 140 also includes a frame member 124, 144 attached to the releasable clamp 122, 142. As seen in the drawings, a first end 160 of the elongated support member 102 is inserted into and held by the first frame member 124. A second end 180 of the elongated support member 102 is inserted into and held by the second frame member 144.

Embodiments of a trapeze, including, but not limited to, the trapeze system 100 shown in FIGS. 1A-1C, may optionally provide one or more features that increase the adjustability of the trapeze and/or provide other benefits and uses, especially when compared with past trapeze systems. As one example, the embodied trapeze system 100 illustrated in FIGS. 1A-1C provides an elongated support member 102 that is infinitely positionable along portions of the first and the second flexible suspension members 110, 112. As will be discussed further herein, the releasable clamps 122, 142 allow the coupling mechanisms 120, 140 to be positioned at any number of points along the flexible suspension members. The infinite adjustability of the coupling mechanisms provides the trapeze system 100 with a wide range of heights, while at the same time sufficiently supporting the weight of the person using the trapeze. This optional combination of features can be useful for people who may use the trapeze for several different types of movements and exercises.

As another possible feature, the trapeze system 100 includes two separate flexible suspension members 110, 112, instead of a single suspension member. This can allow the trapeze to be suspended from a single point of support or from two separate supports. A user of the trapeze system 100 thus has an option to change the support configuration for the trapeze system 100 if a particular movement or technique may benefit from a single support or a two-point support system. As just two examples, the trapeze system 100 can be suspended from a single support to facilitate spinning techniques, or may be suspended from double supports to provide a more stable base for static techniques.

As shown in FIGS. 1A-1C, the trapeze system 100 also provides an optional capacity to disassemble into component parts, which can then be easily stowed, transported, replaced, and/or reassembled for further use. As already mentioned, the coupling mechanisms 120, 140 shown in the figures illustrate an additional feature in that the coupling mechanisms are removably coupled to the elongated support member 102. The coupling mechanisms may or may not be removably coupled to both of the flexible suspension members 110, 112. In some applications, it may be desirable to permanently or semi-permanently couple a suspension member with a coupling mechanism in order to, e.g., limit the possibility that the suspension member will inadvertently slip out of the coupling mechanism during use.

On the other hand, in some cases it may be useful to removably couple the suspension member with the coupling mechanism to allow further disassembly of the trapeze system. The coupling mechanisms and support member can thus be removed from the suspension members together, and/or the elongated support member 102 may be removed and then the coupling mechanisms. It is contemplated that this optional degree of adaptability can facilitate the use of different types of support members (e.g., lighter, heavier, stronger) and coupling mechanisms (e.g., particularly suited for different types of flexible suspension members).

Another example of an optional feature of the trapeze system 100 is the use of a retention mechanism to keep the support member 102 engaged with the coupling mechanisms. A still further feature that will be discussed is the optional inclusion of an engagement mechanism that fixes rotation of the elongated support member 102 with respect to the coupling mechanisms 120, 140.

Returning to FIGS. 1A-1C, the flexible suspension members 110, 112 can be formed of any suitable material. In the illustrated embodiment, each suspension member is a length of nylon webbing, which provides a strong, resilient material for suspending the support member 102. Different lengths of material can be used for the suspension members. In one example, the length of each suspension member is slightly less than nine feet. Of course, many different lengths of the suspension members may be used depending upon the type of application and setting.

Webbing made from other synthetic or natural materials (e.g., cotton) may also be used for the suspension members. In addition, the material can optionally be tubular or non-tubular. Other types of material suitable for the suspension members will be known by those skilled in the art. Examples of other types of suspension member materials include ropes, cords, wires, straps, and chains, among other examples. Suspension members can be made from natural, synthetic or a combination of natural and synthetic materials. The choice of material for the suspension members may optionally depend upon the particular type of clamp being used for the coupling mechanisms. For example, it may be desirable to choose a material that slides easily through the clamps 122, 142, but that is also capable of being tightly gripped by the clamps 122, 142. This optional combination of features can enhance adjustability while also ensuring that there is no movement of the coupling mechanisms along the length of the suspension members during use of the trapeze system 100.

FIGS. 1B and 1C partially show that each webbed suspension member 110, 112 is fed through one of the clamps 122, 142. Although not shown, the upper end of each suspension member 110, 112 can optionally be sewn in a loop for hanging the suspension members from hooks or other supports. The lower end of each suspension member 110, 112 may optionally be folded over and sewn to reduce or eliminate the possibility that the suspension members may accidentally slip through the clamps 122, 142. In this case the coupling mechanisms may be considered to be semi-permanently coupled to the suspension members. This is the case when the coupling mechanisms will usually not be removed from the suspension members, and to do so, some alteration of the suspension member or clamp would be needed (e.g., ripping out the stitching of the folded over suspension member). Accordingly, simple and quick removal of the coupling mechanisms from the suspension members is an optional feature that may not always be present or needed.

As discussed above, the flexible suspension members 110, 112 may be separately attached to an elevated support in a two-point connection. FIG. 1A illustrates the suspension members 110, 112 in a more or less parallel arrangement, which can be provided by a two-point connection (not shown). This and other types of attachments to elevated supports are well-known to those skilled in the art, and thus further details are omitted from this disclosure.

Figure 2A:
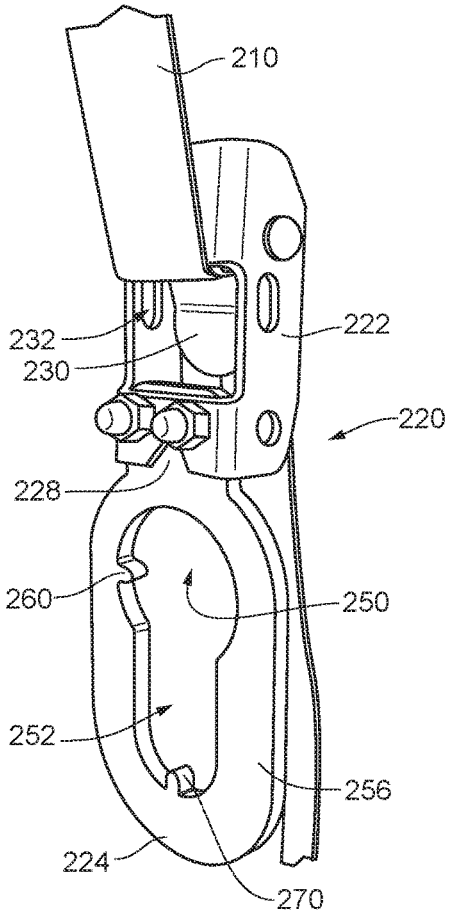
FIGS. 2A and 2B are perspective views of a coupling mechanism of the trapeze system shown in FIG. 1A.
Figure 2B:
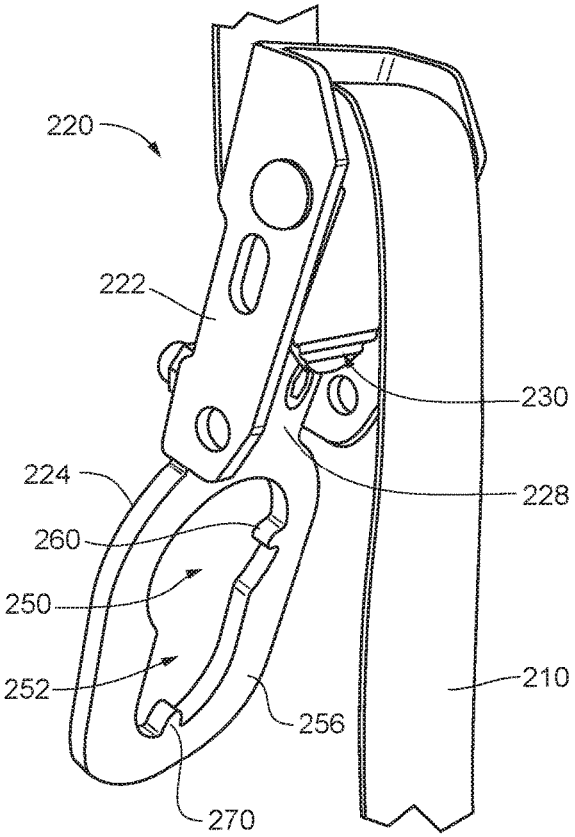

FIGS. 2A and 2B are perspective views of a coupling mechanism 220 like the first and the second coupling mechanisms 120, 140 discussed above with reference to FIGS. 1A, 1B, and 1C. As with those examples, the coupling mechanism 220 depicted in FIGS. 2A and 2B includes a releasable clamp 222 that is coupled to a flexible suspension member 210. The coupling mechanism 220 also includes a frame member 224 that is attached to the releasable clamp 222. In this embodiment the frame member 224 includes a tab portion 228 that is attached to the clamp 222 with bolts and nuts, though any suitable fastener or fastening technology may be used (e.g., mechanical, adhesive, welding, etc.). In addition, it is contemplated that the clamp 222 and the frame member 224 may be integrally connected as part of a one-piece component (e.g., cast or molded as one piece).

The depicted releasable clamp 222 is a standard cam buckle for a 1-inch wide web, though other types and sizes of buckles and clamps may be used. The clamp 222 includes a release button 230 that selectively releases the clamp's grip on the suspension member 210 when it is pressed. To couple the clamp with the suspension member, the suspension member 210 can be fed through a front opening 232 as shown in FIG. 2A, while pressing the release button 230. The suspension member can then be fed up and over the release button 230 as shown in FIG. 2B. Releasing the release button applies tension to the suspension member, thus holding it within the clamp when the clamp and the attached frame are pulled downward.

The clamp 222 is thus selectively adjustable while also engaging the flexible suspension member 210 to provide a secure connection. Pressing the release button 230 allows the coupling mechanism 220 to slide up and down the flexible suspension member 210. Upon releasing the button 230, the button and the remaining portion of the clamp 222 grip the suspension member 210 to retain the location of the coupling mechanism 220 on the suspension member. The coupling mechanism 220 is thus infinitely positionable along the length of the suspension member 210 using the releasable clamp 222.

Turning back to FIG. 1A, it will be appreciated that the infinite adjustability of the coupling mechanisms 120, 140 along the flexible suspension members 110, 112, provides the trapeze system 100 with a wide range of heights. The adjustability provided by the coupling mechanisms 120, 140 can also allow independent positioning of one coupling mechanism with respect to the other coupling mechanism. For example, the first coupling mechanism 120 could be positioned at a lower point on the first flexible suspension member 110, while the second coupling mechanism 140 is positioned at a relatively higher position on the second flexible suspension member 112. This independent and different positioning can provide a slanted or angled orientation for the support member 102. Further, in the case that the flexible suspension members 110, 112 are of unequal length, or suspended from different heights, the independent positioning of the coupling mechanisms could still provide a level orientation for the elongated support member 102.

Returning to FIGS. 2A and 2B, the frame member 224 is configured to receive one of the ends of the elongated support member. As shown, the frame member 224 in this example defines an opening 250 that can receive the end of the support member. The opening 250 is configured to receive the end of the support member. For example, the opening 250 has a compatible shape of sufficient size to allow insertion of the support member end into the opening 250. In the illustrated example, the opening 250 has a circular shape that is compatible with a circular outer flange at the end of the support bar, as will be discussed hereinafter.

The frame member 224 also includes a slot 252. The slot 252 is in communication with and thus also a continuous extension of the opening 250. The slot 252 is thus configured to receive the end of the support member from the opening 250, and vice versa. As shown in the figures, the slot 252 also has a narrower width than the opening. As will be discussed, the narrower width of the slot means that the portion of the frame member 224 surrounding the slot 252 also acts as another frame retention member. In this case the slot 252 also has a length that is optionally greater than the diameter of the opening 250.

In the embodiment illustrated in the figures, the frame member 224 is formed as a rigid planar member that defines the opening 250 and the slot 252 within a common plane. The frame member 224 can be made from any material of suitable strength, and in this embodiment is machined from a sheet of 304 stainless steel with a thickness of less than 0.5 inches. In this example the frame member 224 includes a perimeter region 256 that continuously extends around the opening and the slot.

Of course, many different configurations, shapes, thicknesses and other variations could be implemented in the frame member. For example, instead of having a varying width and forming an oval-shaped outer perimeter, the perimeter region could instead have a substantially constant width so that the outer shape of the frame member 224 follows the contour of the inner perimeter that defines the opening 250 and the slot 252. As a further example, in some cases it may not be necessary for the frame member to have a continuous perimeter.

As mentioned above, the trapeze system 100 shown in FIGS. 1A-1C includes a retention mechanism to keep the support member 102 engaged with the coupling mechanisms. The coupling mechanism 220 shown in FIGS. 2A and 2B illustrates part of such a retention mechanism, though a retention mechanism may be optional and not always included. The retention mechanism includes a frame retention feature that engages a corresponding end retention feature on the end of the elongated support member. In this example, the frame retention feature is a protrusion 260 extending into the opening 250 from the frame member 224. After the end of the elongated support member has been inserted into the opening 250, the protrusion 260 cooperates with the perimeter of the opening 250 to obstruct movement of the support member end out of the opening.

The frame member 224 in FIGS. 2A and 2B also includes part of an optional engagement mechanism made up of a frame engagement feature and a cooperating end engagement feature. Engagement of the frame and end engagement features fixes rotation of the elongated support member with respect to the coupling mechanism 220. The frame member 224 includes a frame engagement feature in the form of a protrusion 270 that extends into the slot 252. The protrusion 270 is configured, e.g., sized and shaped, to fit within a corresponding recess in the end of the support member that forms the end engagement feature. Engagement between the protrusion 270 and the recess prevents rotation of that end of the support member relative to the coupling mechanism.

Figure 3A:
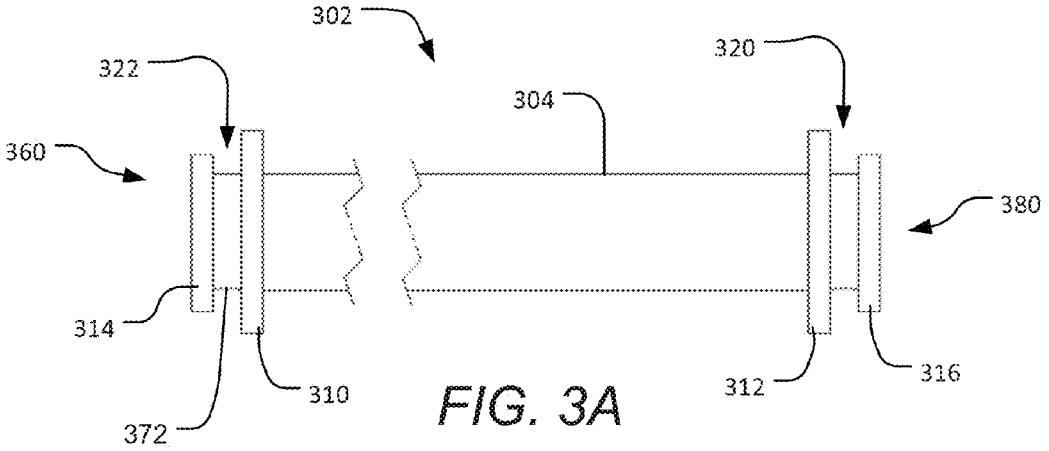
FIG. 3A is a front view of an elongated support member of the trapeze system shown in FIG. 1A.
Figure 3B:
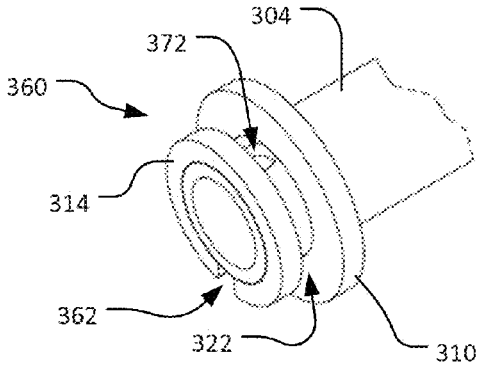
FIG. 3B is a perspective view of one end of the elongated support member shown in FIG. 3A.

FIGS. 3A and 3B are views of an elongated support member 302 like the elongated support member 102 described above with respect to FIGS. 1A-1C. The support member 302 is configured to be removably coupled with a coupling mechanism such as the coupling mechanisms 120, 140 shown in FIGS. 1A-1C, and the coupling mechanism 220 shown in FIGS. 2A and 2B. FIG. 3A is a front view of the elongated support member 302, while FIG. 3B is a perspective view of one end 360 of the support member 302.

As shown in FIGS. 3A and 3B, the support member 302 in this example includes a hollow bar or tube 304 that extends between a first end 360 of the support member and a second end 380. The tube in this example has a one-inch diameter and a wall made from 11-gauge 304 stainless steel, although other metals and alloys (e.g., aluminum), and other suitable non-metal or composite materials may also be used for the tube 304 or a solid bar. In this embodiment, the elongated support member 302 includes inner flanges 310, 312 and outer flanges 314, 316 at each of the first and the second ends 360, 380. The inner and outer flanges at each end of the support member 102 define a channel 320, 322 which is optionally configured to receive part of a coupling mechanism's frame member. For example, the channel 320 may optionally have a width that is just larger than the width of the frame member 224 illustrated in FIGS. 2A and 2B. Accordingly, the closely matching widths will limit the ability of the frame member to translate along the support member 302. Instead, the frame member will stay between the inner and outer flanges at the end of the support member.

Continuing with reference to FIGS. 3A and 3B, each of the ends 360, 380 of the elongated support member 302 include an end retention feature and an end engagement feature that cooperate with the corresponding frame retention feature and frame engagement feature discussed above with respect to FIGS. 2A and 2B.

As shown in FIG. 3B, the outer flange 314 includes a notch 362 that forms the end retention feature at the end of the support member. The notch 362 has a size corresponding to the protrusion 260 of the frame member 224. Accordingly, the protrusion 260 can fit into the notch 362 as the end of the support member is inserted into the opening 250 of the frame member.

Figure 5A:
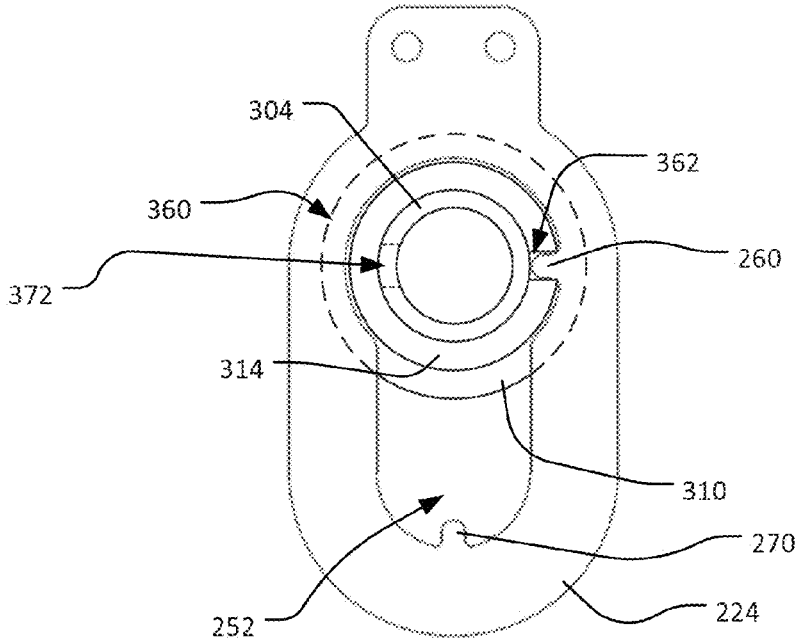
FIGS. 5A and 5B illustrate rotational alignments of an elongated support member and a portion of a coupling mechanism according to an embodiment of the invention.

FIG. 5A illustrates the end 360 of the support member being inserted into the frame member 224, with the notch 362 aligned with the protrusion 260. After coupling the frame member 224 with the end 360 of the support member in this way, rotating the support member relative to the frame member will misalign the notch 362 and the protrusion 260, thus retaining the end of the support member within the frame member. Aligning the protrusion 260 once again with the notch 362 will allow the end 360 of the support member to be removed from the frame member's opening. In the event that the end of the support member is positioned within the slot 252, the outer flange 214 of the support member will contact the narrower width of the slot 252 to also retain the end 360 of the support member within the frame member 224.

Figure 4:
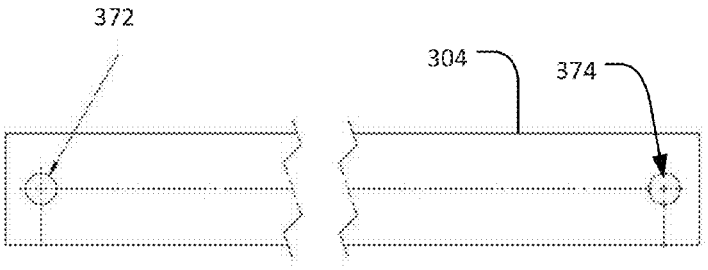
FIG. 4 is a top view of a bar of the elongated support member shown in FIG. 3A.
Figure 5B:
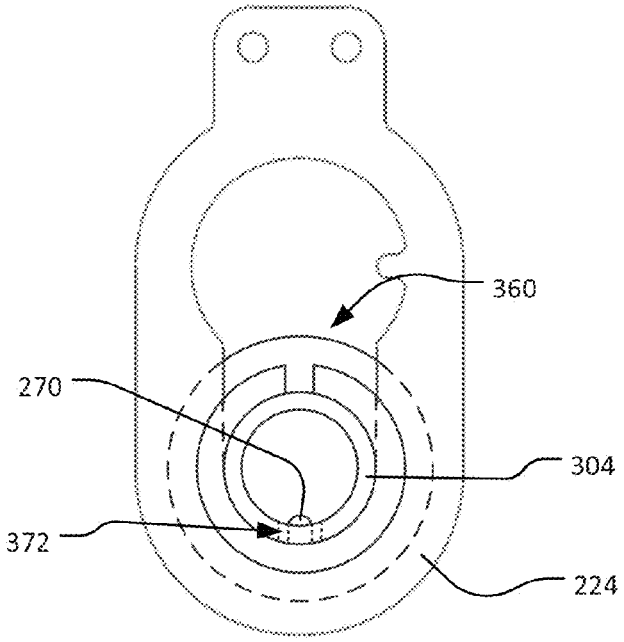

FIG. 3B also illustrates an example of a recess 372 in the surface of the bar 304. The recess 372 is an end engagement feature that engages the protrusion 270 on the frame member 224 shown in FIGS. 2A and 2B. In this example the recess 372 extends through the wall of the hollow tube or bar 304, though this might not always be implemented. As shown in FIG. 4, the bar 304 includes a recess 372, 374 at each end of the bar. FIG. 5B shows the protrusion 270 of the frame member 224 engaged with the recess 372. Engagement of the recess 372 and the protrusion 270 fixes rotation of the end of the support member with respect to the frame member 224.

Figure 6:
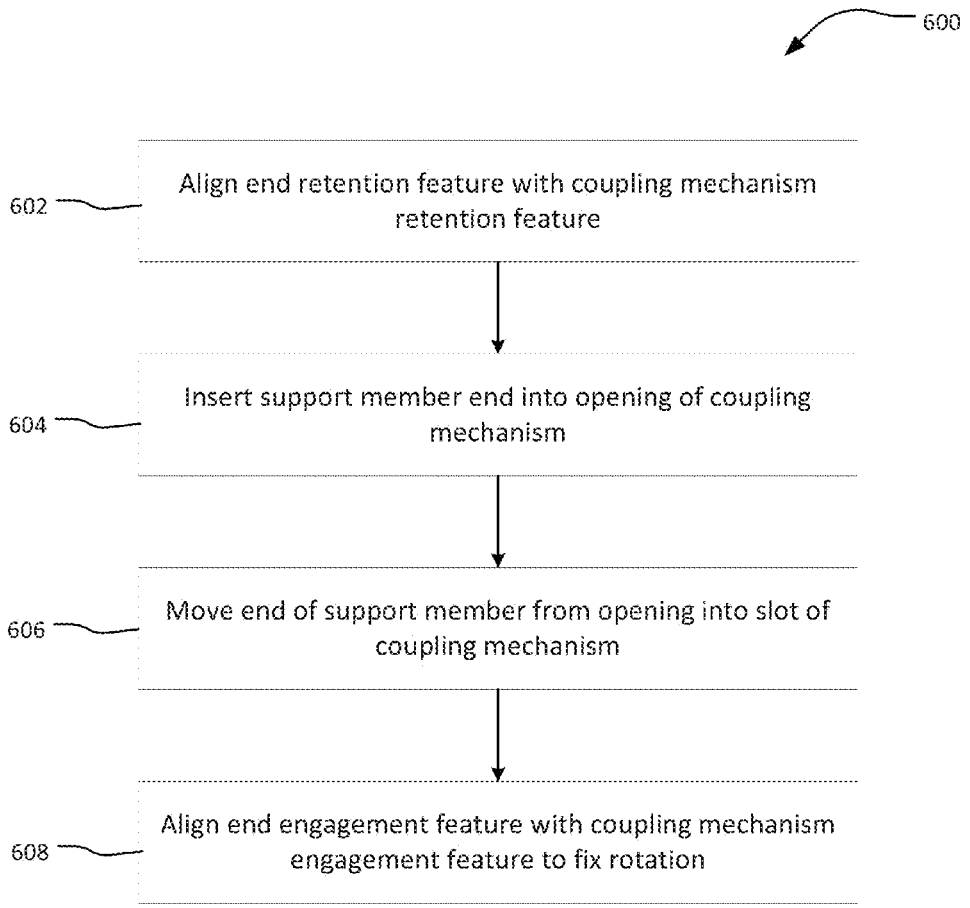
FIG. 6 is a flow diagram illustrating a method for assembling portions of a trapeze apparatus according to an embodiment of the invention.

FIG. 6 is a flow diagram illustrating a method 600 for assembling portions of a trapeze apparatus such as the trapeze shown in FIGS. 1A-1C. The method 600 generally includes steps that involve removably coupling an end of an elongated support member to a coupling mechanism, which can then be repeated for each end of the support member. As shown in FIG. 6, the method 600 includes aligning 602 a retention feature of the end of the elongated support member with a retention feature of the coupling mechanism. An example of this step is shown in FIG. 5A, in which the notch 362, which is the end retention feature, is aligned with the protrusion 260, which is the frame retention feature. The method 600 then involves inserting 604 the end into an opening of the coupling mechanism, such as the opening 250 defined by the frame member 224 illustrated in FIGS. 2A and 2B. After inserting 604 the support member end into the opening, the end of the support member is moved 606 from the opening into a slot of the coupling mechanism. After moving 606 the support member end, the method includes aligning 608 an engagement feature of the end of the elongated support member with an engagement feature of the coupling mechanism. For example, the method may involve aligning the recess 372 with the protrusion 270 so that the protrusion 270 is within the recess. Such an alignment can thus fix or hold still the rotation of the end of the elongated support member with respect to the frame member, and more generally with respect to the coupling mechanism.

Thus, embodiments of the invention are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended claims.

What is claimed is:

1. A trapeze system, comprising:

an elongated support member;

first and second flexible suspension members for suspending the elongated support member;

a first coupling mechanism coupling the first flexible suspension member to the elongated support member; and a second coupling mechanism coupling the second flexible suspension member to the elongated support member;

wherein each of the first and the second coupling mechanisms comprises a frame member defining an opening configured to receive an end of the elongated support member, the end of the elongated support member comprising an end retention feature and an end engagement feature, a frame retention feature that engages the end retention feature to removably retain the end of the elongated support member within the frame member, a slot in communication with the opening, the slot configured to receive the end of the elongated support member from the opening, and a frame engagement feature that engages the end engagement feature to rotatably fix the end of the elongated support member.

2. The trapeze system of claim 1, wherein the first coupling mechanism is infinitely positionable along a length of the first flexible suspension member and the second coupling mechanism is infinitely positionable along a length of the second flexible suspension member.

3. The trapeze system of claim 2, wherein each of the first and the second coupling mechanisms comprises a releasable clamp that selectively grips and moves along the first or the second flexible suspension member.

4. The trapeze system of claim 2, wherein the first and the second flexible suspension members comprise separate lengths of webbing.

5. The trapeze system of claim 1, wherein the frame member comprises a rigid planar member with a perimeter region that encloses the opening and the slot.

6. The trapeze system of claim 5, wherein the end of the elongated support member comprises an inner flange and an outer flange, and wherein at least part of the rigid planar member is positioned between the inner and the outer flanges.

7. The trapeze system of claim 1, wherein a rotational alignment of the end retention feature and the frame retention feature permits removal of the end of the elongated support member from the frame member.

8. The trapeze system of claim 7, wherein rotation of the end of the elongated support member at one end of the slot engages the end engagement feature with the frame engagement feature.

9. The trapeze system of claim 7, wherein engagement of the end engagement feature and the frame engagement feature rotatably fixes the end of the elongated support member in a rotational alignment with the frame member that is different than the rotational alignment of the end retention feature and the frame retention feature.

10. A trapeze bar assembly, comprising:

an elongated support member comprising a first end and a second end, each of the first and the second ends comprising an end retention feature and an end engagement feature; and first and second coupling mechanisms, each coupling mechanism comprising a frame member defining an opening configured to receive one of the ends of the elongated support member, a frame retention feature configured to engage a corresponding end retention feature to removably retain the end of the elongated support member within the frame member, a slot in communication with the opening, the slot configured to receive the end of the elongated support member from the opening, and a frame engagement feature configured to engage a corresponding end engagement feature to rotatably fix the end of the elongated support member within the slot;

wherein the first and the second coupling mechanisms are configured to couple the first and the second ends to corresponding first and second flexible suspension members; and wherein the first and the second coupling mechanisms are infinitely positionable along corresponding lengths of the first and the second flexible suspension members.

11. The trapeze bar assembly of claim 10, wherein the first and the second ends each comprise an inner flange and an outer flange that restrict translation of the first and the second coupling mechanisms along the elongated support member in an assembled state.

12. The trapeze bar assembly of claim 11, wherein the frame member of each of the first and the second coupling mechanisms comprises a rigid planar member that fits between the inner and the outer flanges.

13. The trapeze bar assembly of claim 12, wherein the rigid planar member of each frame member comprises a perimeter region that encloses the opening and the slot of a corresponding coupling mechanism.

14. The trapeze bar assembly of claim 10, wherein the end retention feature comprises a notch and the frame retention feature comprises a protrusion.

15. The trapeze bar assembly of claim 10, wherein the end engagement feature comprises a recess in the elongated support member and wherein the frame engagement feature comprises a protrusion extending into the slot.

16. The trapeze bar assembly of claim 10, wherein each of the first and the second coupling mechanisms comprises a releasable clamp configured to selectively grip and move along the first or the second flexible suspension member.

17. A method for assembling a trapeze apparatus having an elongated support member and first and second coupling mechanisms, the method comprising:

removably coupling a first end of the elongated support member with the first coupling mechanism; and removably coupling a second end of the elongated support member with the second coupling mechanism;

wherein removably coupling each of the first and the second ends with the first and the second coupling mechanisms, respectively, comprises aligning a retention feature of the end of the elongated support member with a retention feature of the coupling mechanism and then inserting the end into an opening of the coupling mechanism, moving the end of the elongated support member from the opening into a slot of the coupling mechanism, and aligning an engagement feature of the end of the elongated support member with an engagement feature of the coupling mechanism to fix rotation of the end of the elongated support member relative to the coupling mechanism.

18. The method of claim 17, further comprising coupling the first coupling mechanism to a first flexible suspension member and coupling the second coupling mechanism to a second flexible suspension member.

19. The method of claim 18, further comprising moving the first coupling mechanism along the first flexible suspension member to one of an infinite number of positions on the first flexible suspension member and moving the second coupling mechanism along the second flexible suspension member to one of an infinite number of positions on the second flexible suspension member.

20. The method of claim 17, wherein aligning the retention features comprises rotating the end of the elongated support member into a first rotational alignment with the coupling mechanism, and wherein aligning the engagement features comprises rotating the end of the elongated support member into a second rotational alignment with the coupling mechanism different than the first rotational alignment.

* * * * *